US006839907B2

(12) United States Patent
Katz

(10) Patent No.: US 6,839,907 B2
(45) Date of Patent: Jan. 11, 2005

(54) CRAFTWORKER'S APRON

(76) Inventor: Lauri G. B. Katz, 11116 Luxmanor Rd., North Bethesda, MD (US) 26852

( * ) Notice: Subject to any disclaimer, the term of this patent is extended or adjusted under 35 U.S.C. 154(b) by 0 days.

(21) Appl. No.: 10/259,909

(22) Filed: Sep. 30, 2002

(65) Prior Publication Data

US 2004/0060091 A1 Apr. 1, 2004

(51) Int. Cl.[7] ..... A41D 13/04
(52) U.S. Cl. ..... 2/48; 2/51
(58) Field of Search ..... 2/48, 51, 50, 52, 2/49.1, 49.2, 49.3, 49.4, 49.5, 102, 94, 105, 106, 46, 47; 1/102, 247, 253, 254; D2/861, 864, 863; 206/574, 575, 581; 224/575, 577, 607, 625, 257

(56) References Cited

U.S. PATENT DOCUMENTS

| | | | | | |
|---|---|---|---|---|---|
| 970,307 | A | * | 9/1910 | Hartmann | 89/196 |
| 1,407,459 | A | * | 2/1922 | Bloch | 2/51 |
| 1,538,982 | A | * | 5/1925 | Grant | 2/51 |
| 1,797,208 | A | * | 3/1931 | Weisz | 2/51 |
| 1,979,879 | A | * | 11/1934 | Harris | 2/48 |
| 2,066,072 | A | * | 12/1936 | Thomas | 2/51 |
| 2,364,258 | A | * | 12/1944 | Wallace | 2/92 |
| 2,466,208 | A | * | 4/1949 | Chanslor et al. | 2/48 |
| 2,607,040 | A | * | 8/1952 | Zaleski | 2/51 |
| 2,616,598 | A | * | 11/1952 | Sexton | 2/48 |
| 2,697,465 | A | * | 12/1954 | Johnson | 383/4 |
| 2,846,685 | A | * | 8/1958 | Ehrich | 2/51 |
| 2,897,505 | A | * | 8/1959 | Lipscomb | 2/48 |
| 3,115,638 | A | * | 12/1963 | Kikas | 2/48 |
| D212,581 | S | * | 11/1968 | Ratay | D2/864 |
| D257,596 | S | * | 12/1980 | Rosenbloom, III | D2/864 |
| D258,020 | S | * | 1/1981 | Bryce | D2/864 |
| D281,638 | S | * | 12/1985 | Thomas | D2/864 |
| 4,791,681 | A | * | 12/1988 | Dean | 2/106 |

* cited by examiner

*Primary Examiner*—A. Vanatta
(74) *Attorney, Agent, or Firm*—Mary Helen Sears

(57) ABSTRACT

An apron-like, unisex garment is disclosed, having at least six pockets for holding implements and supplies needed by a craftsperson such as a knitter, crocheter, quilter, etc in working on a project. The garment ties around the waist and is adapted to be worn while the worker is working on a project, removed in fully loaded condition and set aside while loaded until the worker is ready to resume work on the project. Some pockets may have closures at the top for security in carrying keys or money. The garment may have buttons sewed on it in predetermined patterns and, if so at least some of the pockets are equipped with buttonholes so that they may be buttoned on and removed when no longer needed. Buttoned on pockets may be placed inside larger pockets to afford security.

13 Claims, 3 Drawing Sheets

CRAFTWORKER'S APRON

The present invention concerns an apron—like garment for carrying various implements used in craftworks and other items that the worker may wish to have close at hand. It has been developed with particular attention to the needs and convenience of knitters and crocheters, but could also be used by various others.

BACKGROUND OF THE INVENTION

Specialized items of apparel have long been known in the art. Perhaps the most familiar of these are aprons worn by chefs and other culinary workers, including housewives, to protect them from spills and stains. There are also smocks for painters which have the same functions but may also have pockets for brushes or other implements of varying sizes. Tool belts for carpenters, and specialized aprons for gardeners that have pockets for various implements are also known.

Heretofore, no attention has been given to the needs and conveniences of craftworkers, especially knitters and crocheters. These people have, in general, carried their tools, their yarn, their patterns, and other needed accoutrements in tote bags of varying shapes and dimensions which, in some cases, had one or two interior pockets. These tote bags have all the drawbacks normally experienced with any tote hand bag. They must be carried by hand or over the shoulder, and, if they are deep and roomy, the user often must do a great deal of searching through the items contained therein to find the particular one (or ones) needed at a given moment. The hand or shoulder carriage of the tote may be unwieldy when the user is hurrying from place to place.

Craftworkers, for example, often take classes in their crafts or attend conventions where multiple craft workshops are held. Carrying a separate purse, a tote bag containing a current craft project and items needed to work on it and perhaps other items, such as coats, from one location to another may be awkward and unwieldy. In addition, the dedicated craftworker often wishes to work on his or her current project while waiting in a car, traveling on public transportation, in homes of other craftworkers, in reception areas of doctors, dentists, etc., and in other places where there is no surface available on which to lay out projects, needed tools (needles, scissors, pens, stitch or row counters, etc.), pattern, and any other items that may be helpful.

The craft apron of this invention solves many of these problems because its specialized pockets provide places to put all of the items needed so that is wearer can proceed to work on a project with negligible set-up time and without the need for a surface on which to lay out the pattern.

BRIEF DESCRIPTION OF THE INVENTION

The craft apron of this invention is a unisex, apron—like article of apparel which, when worn, affords its wearer substantial convenience in working on any craft—type project, but especially knitting and crocheting projects. In the preferred embodiment, its basic design comprises a triangular upper body piece wherein one triangular point is adapted to be secured at one of the wearer's shoulders. Attached along one side of this preferred form is a rectangular bottom piece which is wrapped around the wearer's midsection and is tied with long, narrow strips or some other form of ties, one appended to each of the two upper corners of the rectangular piece. Preferably, this apron is made as a "one size fits all" article, but changing size for certain types of people is within the scope of this invention.

In its most preferred and, for most persons, most useful form, the craft apron has three narrow pockets sited on the upper triangular piece and three large pockets on the lower portion, two of which large pockets may each be fashioned with one or more small inside pockets. A third long narrow strip or tie is attached just inside the corner of the rectangular piece that is farthest from the free triangle point. This strip carries the means for fastening the craft apron at its wearer's shoulder.

One of the advantages of the craft apron is that it may be removed after wearing, folded up with its various pockets fully loaded and placed in its own stuff sack, ready to be pulled out and put on at a moment's notice. The stuff sack is preferably so constructed as to be soft and easily foldable so that it can be fitted into one of the lower pockets when the garment is being worn.

The pockets on the upper triangular piece are designed to accommodate scissors, pens, multiple sizes of crochet hooks or double-pointed knitting needles, needles for use in knitting cables and the like. The lower pockets are adapted for holding up to 50—gram skeins or balls of yarn, the pattern, the project (if not too large); a bag or kit of tools such as row and stitch counters, additional knitters needles of greater length than the double pointed needles or of circular form, bobbins and the like, cell phone, glasses, and like items. A secure pocket inside the large center pocket is adapted to hold keys, money, or other small valuables.

DETAILED DESCRIPTION OF THE INVENTION

Figure 3:
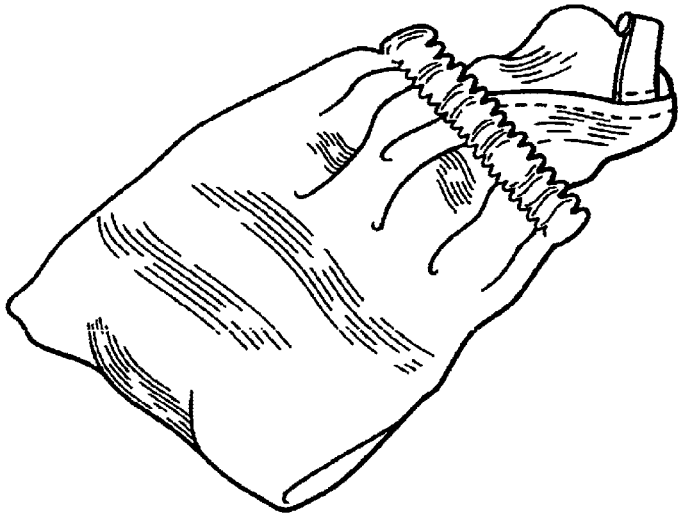
FIG. 3 illustrates a typical stuff sack for use with the craft apron, in process of being stuffed with a folded and rolled up craft apron.

The craft apron of this invention can be made of many fabrics. Preferred fabrics are durable, washable, and relatively soft and pliable so that they are comfortable to wear and can be easily folded, rolled up, and placed in the stuff sack. The stuff sack is preferably of the same material as the craft apron. Especially useful and desirable fabrics include 100% cotton, kettle cloth (50:50 cotton/polyester blend), twill, canvas, and oxford cloth. A flexible, plasticized form of any of the aforementioned materials is also recommended for those who expect to wear the craft apron in the nursery, bath or kitchen, since the plasticized surface can be readily wiped clean.

Non-woven materials, in general, are less preferred than those mentioned above because they often lack body and strength. Similarly, fabrics made by knitting such as jerseys, may be easily snaggable and/or lacking body and strength. Heavy materials that tend to restrict the wearer's freedom of movement are likewise not favored. Treated paper might be used if an inexpensive, disposable garment were desired but these characteristics are not preferred attributes of a craftworker's smock.

The garment is preferably made in one generic size, and, as such, will fit all but the largest and the tiniest adult persons. However, it can be sized in petite, small, medium, large, extra large, and even extra-extra large sizes if desired. This sizing can largely be accomplished by shortening or lengthening of the three very long thin pieces, i.e. the ties at the waist and the single strap connecting to a point of the triangular piece of the garment at one shoulder. For most adults, these adjustments alone effect sizing. Only for children and extremely petite adults, on one side, and for very large men or women, on the other side, is adjustment of the other parts of the garment needed.

The preferred form of the craftpersons' apron is preferably provided, at the triangle point which connects to a tie, with a "D" ring closure which per se affords sufficient sizing. The "D" ring can be replaced with snaps or a button closure similar to the closures used on children's overalls. The triangle point, or a short tie attached to it, can also alternatively be tied to the back tie piece at the correct length with elasticization added to one or both pieces.

The garment could also be made more like a smock by providing a right and left front piece attached to the basic rectangular piece and two complementary back pieces attached to the front pieces at the shoulders, and also providing a single large button closure at the back of the neck while retaining the waist tie. If so made, the back and front pieces can be shaped to provide cap sleeves or even short partial sleeves with fullness at the bottom of each to allow for easy putting on and taking off over the wearer's clothes. In this embodiment, the back may be left open below the button closure. Alternatively, it may be seamed partly up the back. The advantage of this particular configuration is that it allows for additional pockets in the upper portion of the garment.

The crafts apron is preferably cut out and sewn together using a strong stable thread for seaming, such as cotton or polyester—wrapped cotton mid—weight thread or a thread commonly sold for quilting. Nylon thread, which tends to break easily, is not favored.

The stuff sack should be made large enough to allow for easy storage of a fully loaded, folded, and rolled up garment. The preferred closure is a drawstring. A zipper closure would be unsuitable because it might snag materials loaded into the sack. The purpose of this piece is to save the craftpersons' time by keeping the craft apron fully loaded for a particular project. For transportation from place to place, the stuff sack can be loaded into a large tote that also contains other, perhaps less complex, projects so that several items can be easily carried. Alternatively, the stuff sack, containing the loaded crafts apron can be taken to other places by itself.

Figure 5:
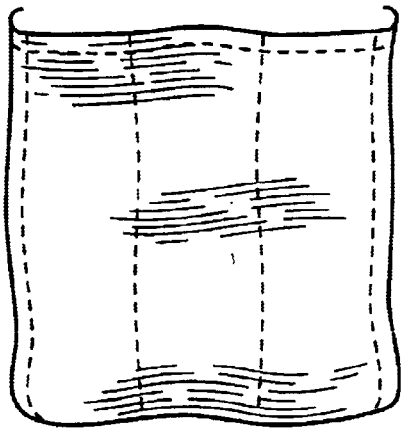
FIG. 5 shows the preferred construction of a pocket to be attached to the upper triangular portion of the craft apron. This pocket is actually three relatively long narrow pockets by virtue of being seamed or otherwise attached to the triangular piece at two locations parallel to its sides.
Figure 1:
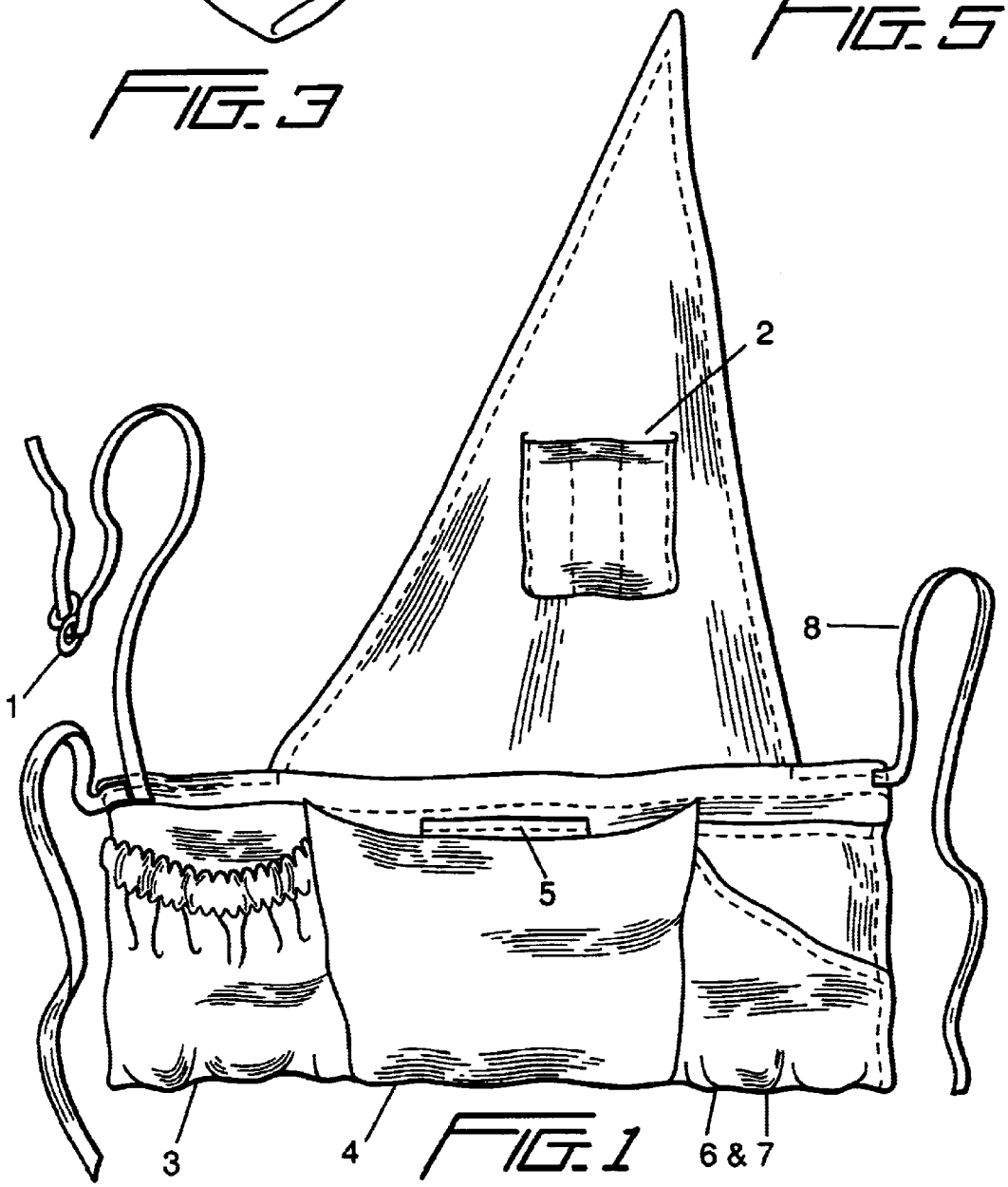
FIG. 1 illustrates a typical craft apron of this invention ready to be loaded and donned by a wearer.
Figure 2A:
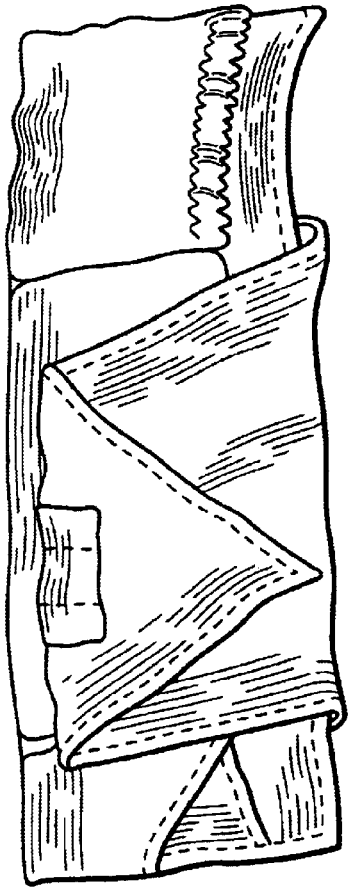
FIGS. 2A and 2B illustrate how easily the craft apron may be folded, each if fully loaded and fitted in its stuff sack.
Figure 2B:
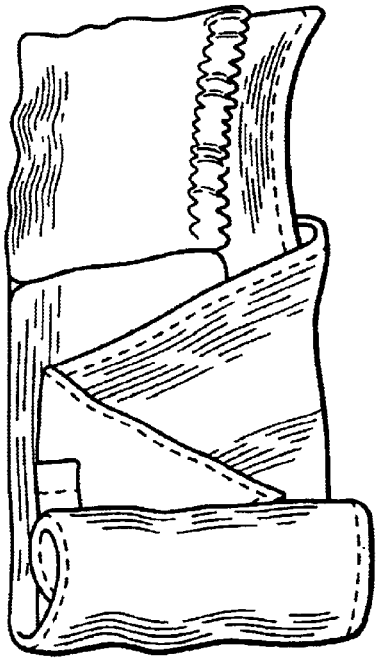
Figure 7:
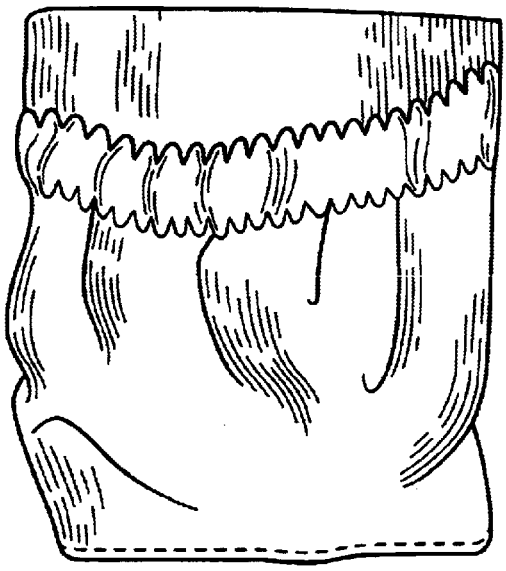
FIG. 7 illustrates a lower side pocket that is elasticized or otherwise adapted to hold a skein or ball of yarn securing.
Figure 8:
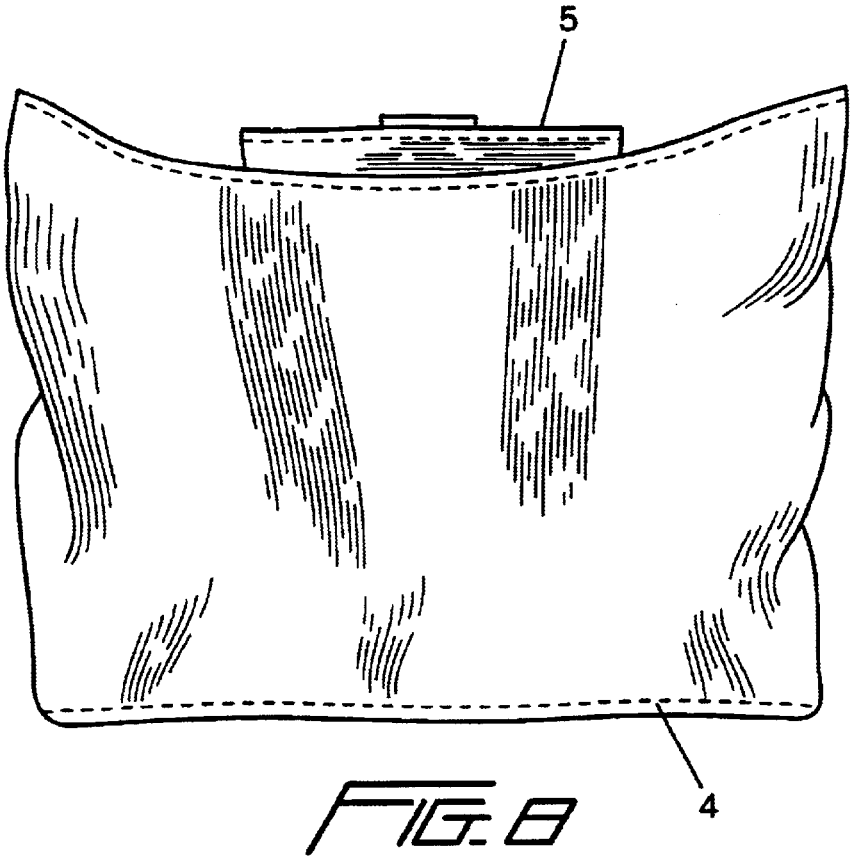
FIG. 8 depicts a center lower pocket encompassing an inside closable secure pocket for keys, credit cards, money, etc.

FIG. 1 shows a typical finished crafts apron of this invention in which the numeral 1 identifies the "D" ring neck closing, numeral 2 identifies a pocket compartmented by seaming into three pockets for pens, etc. This pocket is shown in greater detail in FIG. 5. The numeral 3 of FIG. 1 identifies a lower side pocket, also shown in FIG. 7, the outer portion of which is elasticized at the top. The numeral 4 identifies the center pocket, also shown in FIG. 8, inside which the inner closed pocket for valuables, identified by the numeral 5 is located. At present, the preferred closure of the inner pocket is Velcro®, but snaps or buttons might be substituted. The intention is that small valuables, including keys, money, credit cards, and even small pieces of jewelry, such as rings that might snag yarn, may be stored while the wearer is working on the crafts project. Zippers and hooks and eye arrangements both tend to snag yarn and are not preferred for this pocket closure.

The large center bottom pocket 4 can itself be closed to prevent the pocket contents from spilling out when the wearer bends over or folds the loaded garment for packing. Closures, not shown, especially appropriate to this pocket, are one or even two tab closures that button or snap the pocket closed. Alternatively, a zipper could be used here, if the use of the pocket is such that the possibility of yarn snagging is not a problem.

Numeral 6 of FIG. 1 identifies another form of side bottom pocket, this one containing an interior pocket 7 for cellphones, pocket calculators, and data processing accessories and the like. The pocket 6 is intended for a second skein or ball of yarn and its top may be elasticized, though it is shown here as a simple slash pocket.

Numeral 8 of FIG. 1 identifies a tie of the garment fastened to a corner of the rectangular piece. An identical tie, not numbered in FIG. 1, is attached to the other corner of the rectangular piece.

Figure 4:
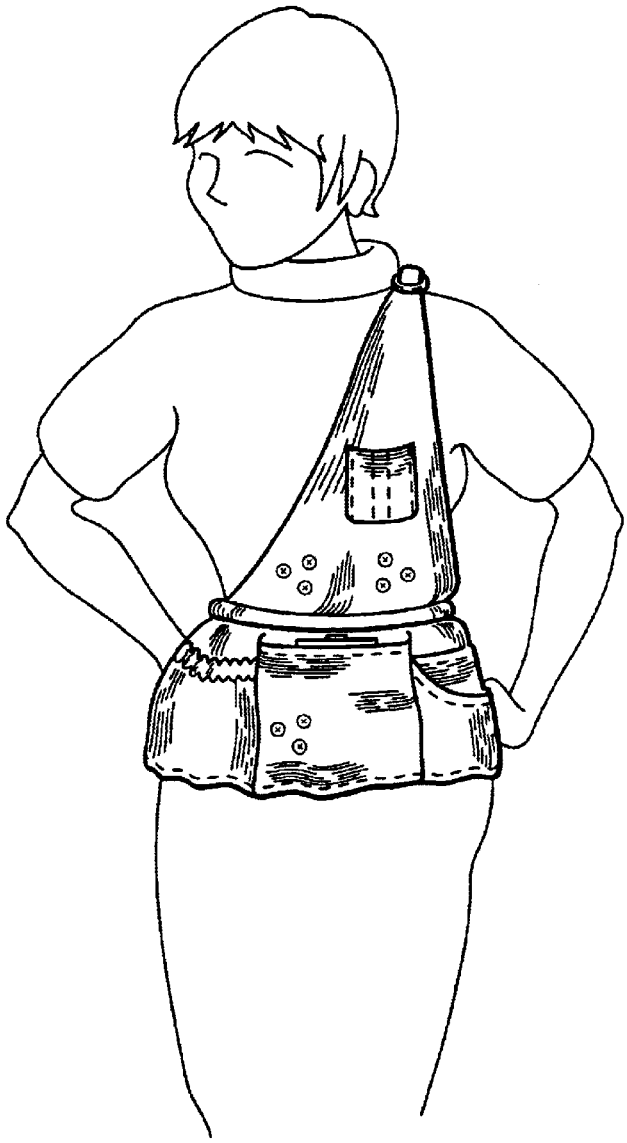
FIG. 4 illustrates the way the craft apron appears when worn. It is cinched at one of the wearer's shoulders and tied in back at her waist.
Figure 6:
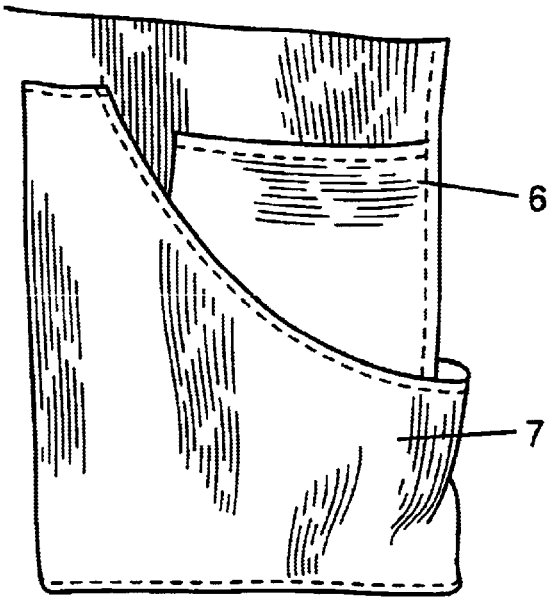
FIG. 6 illustrates a lower side pocket having an inner pocket for holding a cell phone, a pattern, a pocket calculator or a data processing accessory, and an outer pocket especially adapted to hold a second skein or ball of yarn.

Other pockets can be added to the garment as shown in FIG. 1. For example, additional pockets may be placed inside the large pockets or added on top of any of the pockets specifically depicted. Alternatively, or additionally, further pockets might added by buttoning them on a garment provided with pre-determined arrangements of buttons at several positions, making it somewhat like a wearable peg board on which special purpose pockets equipped with buttonholes that can be added to enhance the flexibility of the garment, e.g. to carry more yarns of varying colors or to carry such yarns that have been prewound onto bobbins for use in certain types of colorwork. In FIG. 4, two patterns of three buttons each for receiving button-on pockets appear on the triangular piece of the garment, and one additional button pattern for the same purpose is illustrated on the outside of the middle wide pocket. Special pockets for beads or other decoration to be knit or crocheted into a project could be added. Some or all of the pockets may have square corners as shown in FIG. 1, or they may have round edges. Three-dimensional pockets could also be substituted for any of those shown. The pockets, depending on the specific purpose of each, may be decorated with cutouts. Other possible decorations, usable on any pocket, regardless of purpose are appliques and even embroideries made in yarns or embroidery floss. When button-on pockets are intended to be used and the garment is provided with predetermined button arrangements, button-on pre-sewn pockets are provided with the garment and its stuff sack.

The crafts apron, although intended mainly for use by knitters, crocheters, arts and crafts teachers and the like, is adaptable for the use by other craftspersons including rug hookers, quilters, needlepointers, and many others. It has potential usefulness for workers in any endeavor where freedom of movement of the upper body is essential and where multiple pockets would be advantageous. Potters would find a "wipe clean" version very useful, as would mothers and caretakers of infants and young children who could stay dry while bathing the child but have soap, shampoo, talcum powder, washcloth, small towel, etc. ready available in the pockets. Design engineers might find the garment useful when doing hand drafting. Convention floor workers could use the crafts apron to hold brochures, tools, cell phones, walkie talkie equipment and other needed paraphernalia. Caretakers of the elderly, window dressers and display builders or installers would likewise find the garment very convenient for holding necessary paraphernalia that needs to be close at hand as they work.

The garment depicted in FIG. 1 and on the human being in FIG. 4 is designed to be convenient for a right handed person who can most easily fasten a "D" ring closure on the left shoulder and place articles in or remove them from a left side pocket. It is well within the scope of this invention to reverse the attachment of the triangular piece and the placement of the over-shoulder tie and the "D"-ring so that the triple compartment pocket and the closure are on the right shoulder, thus making the garment easier for left-handed persons to wear and use.

Many other modifications of this invention will readily occur to craftspersons with special needs or desires and to those skilled in garment making and design. It is the intention of the inventor of this garment that the scope of this invention be limited only by the appended claims.

What is claimed is:

1. An apron-like, unisex garment which ties around the wearer's waist and is also fastened on one of the wearer's shoulders to an upwardly extending narrow piece of material that extends upwardly from the wearer's waist over the wearer's back, which garment essentially consists of (a) a triangle-shaped piece of a material that extends upwardly from the wearer's waist when said garment is worn, so that one point of said triangle falls of one of the wearer's two shoulders, (b) a oblong, essentially rectangle-shaped piece of material which is firmly attached on one of its two longer sides to the side of the triangle-shaped piece opposite said point that falls on one of the wearer's shoulders when said garment is worn and which itself extends partway around the wearer on both sides so as to cover, when the garment is worn, at least a part of the wearer's sides below the wearer's waist, (c) two long narrow strips of material which are adapted to tie to one another at the back of the wearer's waist and are each firmly attached to opposite corners of said oblong, essentially rectangle-shaped piece of material at points located on the shorter sides of the rectangle-shaped piece of material that fall, when the garment is worn, on opposite sides of the wearer's back, (d) one long narrow strip of material that is firmly attached to one of the longer sides of the rectangular-shaped piece of material in an upwardly extending direction, at a point located near one end of said rectangle-shaped piece of material, said long narrow strip of material being equipped to extend upwardly over the wearer's back and be fastened at the wearer's shoulder, when the garment is worn, to said one point of said triangle-shaped piece of material essentially taut across the front of the wearer's body, (e) at least six pockets which are formed by attaching additional suitably shaped pieces of material to the portion of said garment which comprises the triangle shaped piece and the oblong, essentially rectangle shaped piece before or after the attachment thereto of the two long narrow strips specified in part (c) hereof and the long narrow strip, specified in part (d) hereof, said at least six pockets being further characterized in that (i) three of said at least six pockets are parallel, long, narrow compartments attached to the triangle-shaped piece of material and are initially formed by attaching a single piece of material of a desired dimension to said triangle shaped piece to form one open pocket and then making three long narrow compartments in said one pocket by sewing three vertical, parallel, spaced apart, seams through the thicknesses of both the triangle shaped piece and the attached open pocket piece to form three vertical parallel, long, narrow compartments in the portion of said garment that extends above the waist when worn and (ii) at least three wide, deep, pockets are separately attached to the rectangular section by seaming separate pieces of material thereon so that all of the portion of said garment, that when worn, falls below the wearer's waist, is essentially covered by these at least three wide, deep pockets.

2. A garment according to claim 1, wherein, within at least two of said three separately attached, wide, deep pockets, there is placed at least one small interior pocket for holding small items, by separately sewing to said rectangle-shaped piece within the area to be covered by or already covered by, one of said wide, deep pockets a small, appropriately sized and shaped piece of material, in such a manner as to fasten to said rectangle shaped piece about three-fourths of the periphery of said small, appropriately sized and shaped piece while leaving about one fourth of the periphery thereof as a pocket opening, so as to form a small interior pocket.

3. A garment according to claim 2 wherein at least one said small interior pocket is equipped with means for closing and reopening the unsewn portion of its periphery.

4. A garment according to claim 1 wherein at least one of said at least three separately wide, deep pockets is elasticized at its upper open edge and is seamed on the bottom by gathering the fabric to create an expandable pocket.

5. A garment according to claim 1 in which a middle member of said at least three separately attached wide, deep pockets is wider than each of the other separately attached wide, deep pockets.

6. A garment according to claim 5 wherein at least two small interior pockets are located within the middle member of said at least three separately attached wider deep pockets.

7. A garment according to claim 1 wherein at least one of said at least three wide, deep pockets is closed at the top with at least one tab and button reciprocal closure.

8. A garment according to claim 1 wherein a matching separate sack is provided, in which the garment, with pockets fully loaded, may be folded and carried or stored in ready-to-use condition.

9. A garment according to claim 1 wherein one or more additional exterior pockets are attached to said garment.

10. A garment according to claim 9 wherein said one or more exterior pockets are button-on pockets.

11. A garment according to claim 10 wherein buttons distributed in predetermined patterns that coincide with buttonhole patterns on separate pieces of material that may be buttoned onto the garment when desired and unbuttoned when no longer needed, are present on the triangle-shaped member of said garment.

12. A garment according to claim 10 wherein buttons distributed in predetermined patterns that coincide with buttonhole on separate pieces of material that may be buttoned onto the garment when desired and unbuttoned when no longer needed, are present on the exterior of at least one of the said at least three wide, deep pockets.

13. A garment according to claim 10 wherein buttons distributed in predetermined patterns that coincide with buttonhole on separate pieces of material that may be buttoned onto the garment when desired and unbuttoned when no longer needed, are present on the triangle-shaped member of the garment and also on at least one of the said at least three wide, deep pockets.

* * * * *